US007913322B2

(12) United States Patent
Aldridge

(10) Patent No.: US 7,913,322 B2
(45) Date of Patent: Mar. 29, 2011

(54) GARMENT WITH PADDING

(75) Inventor: Donald Aldridge, New Carlisle, OH (US)

(73) Assignee: Lion Apparel, Inc., Dayton, OH (US)

( * ) Notice: Subject to any disclaimer, the term of this patent is extended or adjusted under 35 U.S.C. 154(b) by 922 days.

(21) Appl. No.: 11/313,205

(22) Filed: Dec. 20, 2005

(65) Prior Publication Data

US 2007/0136923 A1 Jun. 21, 2007

(51) Int. Cl.
*A62B 17/00* (2006.01)
*A41D 27/26* (2006.01)

(52) U.S. Cl. ..... 2/81; 2/267

(58) Field of Classification Search ..... 2/267, 458, 2/81, 93, 24
See application file for complete search history.

(56) References Cited

U.S. PATENT DOCUMENTS

| | | | | |
|---|---|---|---|---|
| 4,046,939 | A | 9/1977 | Hart | |
| 4,757,094 | A | 7/1988 | Teumac et al. | |
| 4,843,646 | A * | 7/1989 | Grilliot et al. | 2/69 |
| 4,885,206 | A * | 12/1989 | Graalmann et al. | 428/316.6 |
| 5,031,242 | A * | 7/1991 | Aldridge et al. | 2/81 |
| 5,150,476 | A * | 9/1992 | Statham et al. | 2/93 |
| 5,182,163 | A | 1/1993 | Wheat et al. | |
| 5,236,769 | A * | 8/1993 | Paire | 428/196 |
| 5,267,354 | A * | 12/1993 | Grilliot et al. | 2/23 |
| 5,436,278 | A | 7/1995 | Imashiro et al. | |
| 5,539,928 | A * | 7/1996 | Aldridge | 2/93 |
| 5,542,124 | A * | 8/1996 | Grilliot et al. | 2/81 |
| 5,551,084 | A * | 9/1996 | Freese, III | 2/23 |
| 5,634,215 | A * | 6/1997 | DeBaene | 2/227 |
| 5,697,101 | A | 12/1997 | Aldridge | |
| 5,701,606 | A | 12/1997 | Aldridge | |
| 5,720,045 | A | 2/1998 | Aldridge | |
| 5,724,673 | A * | 3/1998 | Aldridge | 2/81 |
| 5,729,832 | A * | 3/1998 | Grilliot et al. | 2/23 |
| 5,884,332 | A * | 3/1999 | Snedeker | 2/97 |
| 5,896,583 | A * | 4/1999 | Grilliot et al. | 2/81 |
| 5,924,134 | A | 7/1999 | Taylor et al. | |
| 5,928,971 | A * | 7/1999 | Ellis et al. | 442/76 |
| 5,935,882 | A * | 8/1999 | Fujita et al. | 442/247 |
| 6,049,906 | A | 4/2000 | Aldridge | |
| 6,397,401 | B2 | 6/2002 | Belcher | |

(Continued)

FOREIGN PATENT DOCUMENTS

EP 1510408 3/2005

OTHER PUBLICATIONS

PCT, International Preliminary Report on Patentability, International Application No. PCT/US06/47054 (Nov. 19, 2010).

*Primary Examiner* — Alissa L Hoey
(74) *Attorney, Agent, or Firm* — Thompson Hine LLP

(57) ABSTRACT

A garment including an outer shell configured to be worn on at least part of a body of a wearer and a pad directly or indirectly coupled to a selected location of the outer shell to provide padding at the selected location. The pad includes an open cell foam padding material which resists melting, dripping or igniting when exposed to a temperature of 500 degrees Fahrenheit for five minutes. The padding material has a sealant located thereon to reduce the absorption of moisture therein. The pad further includes an abrasion resistant material coupled to the padding material by the sealant.

36 Claims, 4 Drawing Sheets

U.S. PATENT DOCUMENTS 6,455,623 B1 * 9/2002 Howard ..... 524/474
6,607,817 B1 8/2003 Imashiro et al.
6,687,913 B2 * 2/2004 Aldridge ..... 2/81
6,743,498 B2 * 6/2004 Fourmeux ..... 428/131
6,800,666 B2 10/2004 Hahnle et al.
6,886,184 B2 * 5/2005 Underwood et al. ..... 2/82
7,013,496 B2 * 3/2006 Dunn ..... 2/458
7,026,044 B2 * 4/2006 Braun et al. ..... 428/304.4
2001/0041753 A1 11/2001 Thom
2002/0163105 A1 * 11/2002 Kosaka et al. ..... 264/321
2004/0117895 A1 * 6/2004 Fortner ..... 2/267
2004/0231564 A1 * 11/2004 Braun et al. ..... 106/601
2005/0097658 A1 * 5/2005 Lyons et al. ..... 2/267
2005/0136238 A1 * 6/2005 Lindsay et al. ..... 428/304.4
2006/0277651 A1 * 12/2006 Razzaghi et al. ..... 2/81
2007/0289047 A1 * 12/2007 Fortner ..... 2/268

* cited by examiner

GARMENT WITH PADDING

The present invention is directed to a protective garment, and more particularly to a protective garment having padding able to withstand relatively high temperatures.

BACKGROUND

Protective or hazardous duty garments are used in a variety of industries or settings to protect the wearer from hazardous conditions such as heat, smoke, cold, sharp objects, chemicals, liquids, fumes and the like. Such protective or hazardous duty garments are often used in adverse conditions, such as high heat, exposure to smoke or chemicals and the like. In addition, the wearers of such garments are often required to crouch or crawl to assume a defensive/protective position, and are often required to carry relative heavy items.

Accordingly, various areas of the garment, such as knee, elbow, shoulder, hip or other regions may be padded to provide comfort and protection. In addition, these (or other) areas of the garment may be compressed, such as when a wearer crawls on his or her knees, rests on his or her elbows or hips, or carries a load on his or her shoulders. When the garment is compressed in this manner, the heat protection of the garment may be reduced in that area. Thus, locating protective pads on these areas may provide additional heat protection and load absorbing protection to the wearer and the garment.

However, existing padding material can add additional bulk and/or weight to the garment. In addition, some padding materials may be prone to absorbing moisture which can increase the weight of the garment. In particular, the clothing may be exposed to moisture during use (i.e., when using water during firefighting), from perspiration of a wearer, during cleaning of the garment or the like. The absorption of moisture can also reduce the thermal/heat protection provided by the garment and add discomfort to the wearer. Accordingly, there is a need for a protective garment having improved pads.

SUMMARY

In one embodiment, the invention is directed to a protective garment having pads which are relatively lightweight, nonbulky, and resist absorption of moisture. In particular, in one embodiment, the invention is a garment including an outer shell configured to be worn on at least part of a body of a wearer and a pad directly or indirectly coupled to a selected location of the outer shell to provide padding at the selected location. The pad includes an open cell foam padding material which resists melting, dripping or igniting when exposed to a temperature of 500 degrees Fahrenheit for five minutes. The padding material has a sealant located thereon to reduce the absorption of moisture therein. The pad further includes an abrasion resistant material coupled to the padding material by the sealant.

In another embodiment the invention is a garment including an outer shell configured to be worn on at least part of a body of a wearer, and a pad directly or indirectly coupled to a selected location of the outer shell to provide padding at the selected location. The pad includes an open cell melamine resin foam padding material with a sealant located thereon to limit the absorption of moisture. The pad further includes an abrasion resistant material coupled to the open cell foam by the sealant.

DETAILED DESCRIPTION

Figure 1:
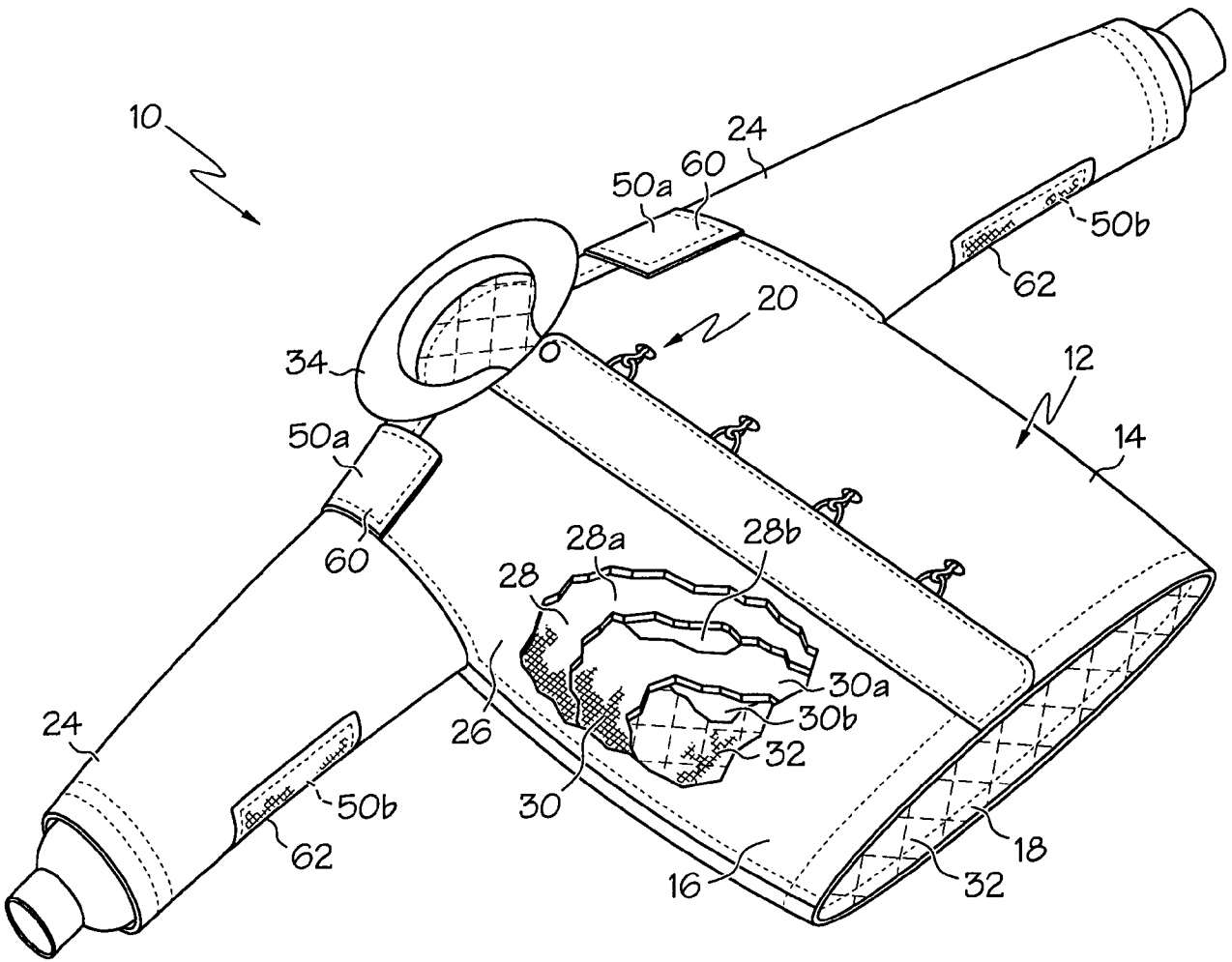
FIG. 1 is a front view of a protective garment in the form of a coat according to one embodiment of the present invention, with portions of the coat cut away to illustrate the various layers thereof.

FIG. 1 illustrates a protective or hazardous duty garment in the form of a firefighter's coat, generally designated 10. The coat 10 may include a body portion 12 having a left front panel 14, right front panel 16 and a back panel 18. The left front panel 14 and right front panel 16 may be releasably attachable by a fastener 20, such as a zipper, snaps, clasps, clips, hook-and-loop fastening material (i.e., VELCRO®) or the like. The body portion 12 may define a torso cavity that is shaped to receive a wearer's torso therein. The coat 10 may include a pair of sleeves 24 coupled to and extending generally outwardly from the body portion 12 and may be shaped to receive a wearer's arms therein.

The coat 10 may include various layers through its thickness to provide various heat, moisture and abrasion resistant qualities to the coat 10 so that the coat 10 can be used as a protective, hazardous duty, or firefighter garment. For example, the coat 10 may include an outer shell 26, a moisture barrier 28 located inside of and adjacent to the outer shell 26, a thermal liner or barrier 30 located inside of and adjacent to the moisture barrier 28, and an inner liner or face cloth 32 located inside of and adjacent to the thermal liner 30.

The outer shell 26 may be made of or include a variety of materials, including a flame, heat and abrasion resistant material such as a compact weave of aramid fibers and/or polybenzarnidazole fibers. Commercially available aramid materials include NOMEX and KEVLAR fibers (both trademarks of E.I. DuPont de Nemours & Co., Inc. of Wilmington, Del.), and commercially available polybenzamidazole fibers include PBI fibers (a trademark of PBI Performance Fabrics of Charlotte, N.C.). Thus, the outer shell 26 may be an aramid material, a blend of aramid materials, a polybenzamidazole material, a blend of aramid and polybenzamidazole materials, or other appropriate materials. The materials of the outer shell 26 may have a weight of, for example, between about 6-10 oz/yd$^2$.

The moisture barrier 28 and thermal liner 30 may be generally coextensive with the outer shell 26, or spaced slightly inwardly from the outer edges of the outer shell 26 (i.e., spaced slightly inwardly from the outer ends of the sleeves 24, the collar 34 and from the lower edge of the coat 10) to provide moisture and thermal protection throughout the coat 10. The moisture barrier 28 may include a semi-permeable membrane layer **28*a* and a substrate 28*b*. The membrane layer 28*a*** may be generally moisture vapor permeable but generally impermeable to liquid moisture.

The membrane layer **28*a* may be made of or include expanded polytetrafluoroethylene ("PTFE") such as GORE-TEX or CROSSTECH materials (both of which are trademarks of W.L. Gore & Associates, Inc. of Newark, Del.), polyurethane-based materials, neoprene-based materials, cross-linked polymers, polyamid, or other materials. The membrane layer 28*a* may have microscopic openings that permit moisture vapor (such as water vapor) to pass therethrough, but block liquids (such as water) from passing therethrough. The membrane layer 28*a* may be made of a microporous material that is either hydrophilic, hydrophobic, or somewhere in between. The membrane layer 28*a* may also be monolithic and may allow moisture vapor transmission therethrough by molecular diffusion. The membrane layer 28***a* may also be a combination of microporous and monolithic materials (known as a bicomponent moisture barrier), in which the microporous or monolithic materials are layered or intertwined.

The membrane layer 28*a* may be bonded or adhered to a substrate 28*b* of a flame and heat resistant material to provide structure and protection to the membrane layer 28*a*. The substrate 28*b* may be or include aramid fibers similar to the aramid fibers of the outer shell 26, but may be thinner and lighter in weight. The substrate 28*b* may be woven, non-woven, spunlace or other materials. In the illustrated embodiment, the membrane layer 28*a* is located between the outer shell 26 and the substrate 28*b*. However, the orientation of the moisture barrier 28 may be reversed such that the substrate 28*b* is located between the outer shell 26 and the membrane layer 28*a*.

The thermal liner 30 may be made of any suitable material that provides sufficient thermal insulation. In one embodiment, the thermal liner 30 may include a relatively thick (i.e. between about 1/16"-3/16") batting, felt or needled non-woven material 30*a* which can include aramid fiber batting (such as NOMEX batting), aramid needlepunch material, an aramid non-woven material, an aramid blend needlepunch material, an aramid blend batting material, an aramid blend non-woven material, or foam (either open cell or closed cell) materials. The batting 30 may trap air therein and possesses sufficient loft to provide thermal resistance to the coat 10.

The batting 30*a* is typically quilted to a thermal liner face cloth 30*b* which can be a weave of a lightweight aramid material. Thus, either the batting 30*a* alone, or the batting 30*a* in combination with the thermal liner face cloth 30*b*, may be considered to constitute the thermal liner 30. In one embodiment, the thermal liner 30 may have a thermal protection performance ("TPP") of at least about twenty, or of at least about thirty-five.

In the illustrated embodiment, the batting 30*a* is located between the outer shell 26 and the thermal liner face cloth 30*b*. However, the orientation of the thermal liner 30 may be reversed such that the thermal liner face cloth 30*b* is located between the outer shell 26 and the batting 30*a*. If desired, the thermal liner 30 may be treated with a water-resistant or water-repellent finish. In addition, although the moisture barrier 28 is shown as being located between the outer shell 26 and the thermal liner 30, the positions of the moisture barrier 28 and thermal liner 30 may be reversed such that the thermal liner 30 is located between the outer shell 26 and the moisture barrier 28.

The face cloth 32 may be the innermost layer of the coat 10, located inside the thermal liner 30. The face cloth 32 can provide a comfortable surface for the wearer and protect the thermal liner 30 and/or moisture barrier 28 from abrasion and wear.

Each layer of the coat 10, and the coat 10 as a whole, may meet the National Fire Protection Association ("N.F.P.A.") 1971 standards for protective firefighting garments ("Protective Clothing for Structural Firefighting"), which are entirely incorporated by reference herein. The NFPA standards specify various minimum requirements for heat and flame resistance and tear strength. For example, in order to meet the NFPA standards, the outer shell 26, moisture barrier 28 and thermal liner 30 must be able to resist igniting, burning, melting, dripping and/or separation at a temperature of 500° F. for at least five minutes. Furthermore, in order to meet the NFPA standards, all combined layers of the coat 10 must provide a thermal protective performance rating of at least thirty-five.

Figure 3:
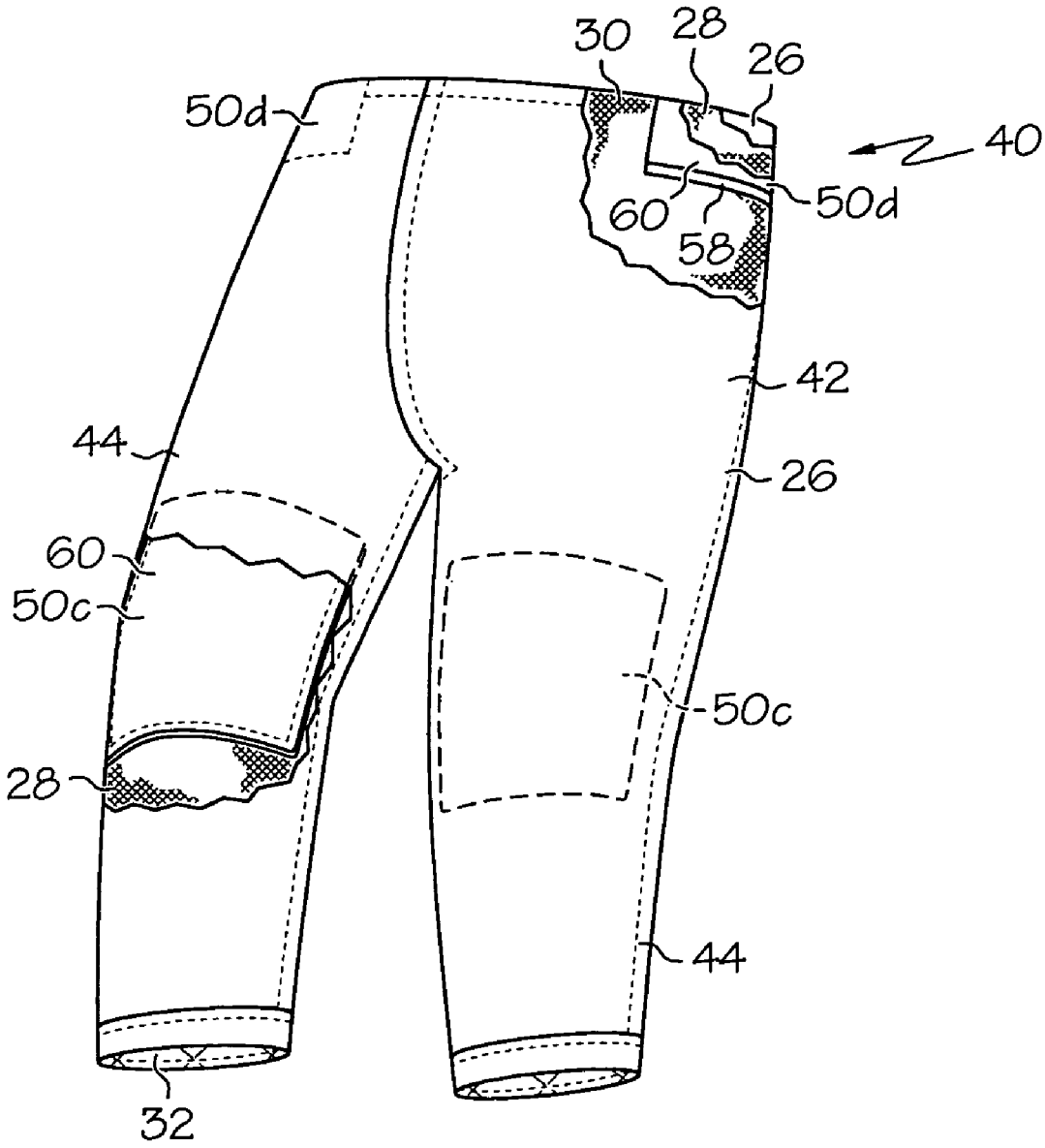
FIG. 3 is a front perspective view of a protective garment in the form of a pair of trousers, with portions of the trousers cut away.

As shown in FIG. 3, the protective or hazardous duty garment may take the form of a pair of trousers 40. The trousers 40 may have the same construction as the coat 10 described above, including the outer shell 26, moisture barrier 28, thermal liner 30 and face cloth 32. The trousers 40 may include a body portion 42 is shaped and configured to receive the pelvis or lower portion of a wearer's torso therein. The trousers 40 may include a pair of leg portions 44 coupled to and extending generally outwardly or downwardly from the body portion 42 and may be shaped and configured to receive a wearer's legs therein. In addition, the garment of the present invention may include or take the form of vests, jumpsuits, full-body jumpsuits including a coat and trousers combined into a single garment, and the like.

Figure 4:
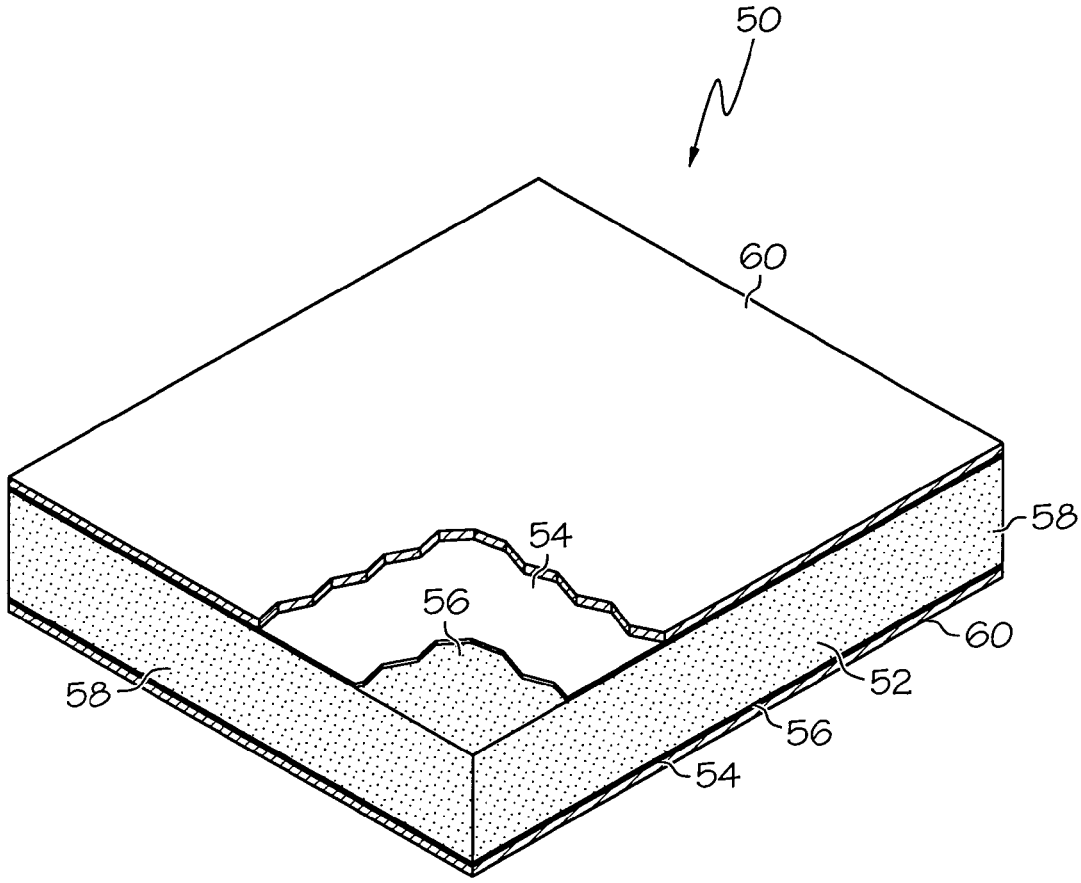
FIG. 4 is a front perspective view of one embodiment of the pad of the present invention.

The garments 10, 40 may include one or more pads 50 positioned at selected, discrete and spaced apart locations on the garment. As best shown in FIG. 4, each of the pads 50 may be made of or include an open cell foam padding material 52. In one case, the padding material 52 is an open cell melamine resin foam such as BASOTECT™ foam sold by BASF Corporation of Rhein, Germany. In this case the padding material 52 may be a flexible, open-cell foam made from melamine resin, which is a thermoset plastic from aminoplastics group. The foam 52 may include relatively delicate three-dimensional filigree network structure formed from slender and hence readily thermoformable filaments. The padding material 52 may be relatively lightweight and in one case has a density of less than about 15 kg/cubic meter, and more particularly less than about 10 kg/cubic meter. The lightness of the padding material 52 can be of a significant benefit and reduce stress upon the wearer.

The padding material 52 may be relatively soft and pliable to provide shock absorption and load distribution qualities. For example, the padding material 52 may be easily compressed when pressed down upon by a user's finger, and generally return to its original shape when the pressing force is removed. The padding material 52 can have a variety of thicknesses, for example, at least about 3 mm, or about 6 mm.

Because the padding material 52 is made of open cell foam, it may be desired to locate a sealant 54 on the foam to generally seal the open cells and eliminate, reduce or limit the absorption of moisture into and through the padding material 52. The sealant 54 generally covers and seals the open cells of the padding material 52 that are contacted by the sealant 54. In one embodiment, the sealant 54 is a urethane coating although the sealant 54 can be made of other materials which provide the desired sealing and adhesive properties. The sealant 54 can have a variety of thicknesses, such as between about 1 and 10 mils, and more particularly between about 2 and 5 mils (with the drawings not necessarily being to scale).

In the illustrated embodiment, the padding material 52 is a generally planar and flat sheet-like material having a pair of opposed major surfaces 56. In this case, the sealant 54 may cover substantially both of the opposed major surfaces 56 to seal substantially the entire padding material 52. However, if desired, and under certain circumstances, only one of the major surfaces 56 or even only part thereof, may be covered by the sealant 54. In addition, it may be desired to seal the peripheral end or edge surfaces 58 of the padding material 52 to provide complete moisture protection to the padding material 52. The sealant 54 may not necessarily provide complete waterproofing to the pad 50. Instead, in one case the sealant 54 may primarily protect from "hot moisture" such as steam or the like from penetrating into or through the pad 50. Such hot moisture can quickly heat a wearer of a garment, and therefore the protection provided by the sealant 54 can be quite useful.

The pad 50 may further include an abrasion resistant material 60 coupled to the padding material 52 by the sealant 54. The abrasion resistant material 60 may be coupled to part or all of the major surfaces 56, or end surfaces 58 as desired. The abrasion resistant material 60 provides protection to the padding material 52, since the padding material may be relatively fragile and prone to ripping, tearing, puncturing and the like.

In one embodiment, the abrasion resistant material 60 may be a fabric, such as a woven fabric or a non-woven (including spun-lace) fabric, such as E-89™ or (Nomex E-89™), or E-88™ or (Nomex E-88™), both sold by E. I. du Pont de Nemours and Company of Wilmington, Del. However, the abrasion resistant material 60 can be made of nearly any other materials which provide the desired protection and strength. The abrasion resistant material 60 may be relatively thin, such as between about 5 mils and about 30 mils. In addition, the abrasion resistant material 60 may be relatively lightweight, and in one case has a weight of about 1.5 ounces per square yard.

As noted above, in one embodiment the abrasion resistant material 60 may be coupled to the padding material 52 by the sealant 54. The abrasion resistant material 60 may be securely attached such that the abrasion resistant material 60 cannot be removed without tearing the padding material 52. Thus, the sealant 54 may serve the dual purpose of both sealing the open cell foam padding material 52, and adhering, bonding or coupling the abrasion resistant material 60 to the padding material 52.

The padding material 52 may be made of a material which resists melting, dripping or igniting, and which generally fully retains its flexibility when exposed to temperatures of 500° F. for five minutes. In addition, the pad 50 as a whole (i.e., including the padding material 52, sealant 54 and abrasion resistant material 60) may be relatively heat resistant and be able to resist melting, dripping and/or igniting when exposed to temperatures of 500° F., or 1000° F. for five minutes.

In order to form the pad 50, the padding material 52 may first be provided, such as in relatively large sheet form. The sealant 54, such as urethane, is located on the major surface(s) 56 (and/or end surfaces 58 if desired) of the padding material 52. The sealant 54 can be applied in sheets (i.e., in solid form) which are laid on the padding material 52, or can be brushed on (i.e., in liquid form). The padding material 52/sealant 54 is then heated until the sealant 54 becomes sufficiently tacky to adhere the sealant 54 to the padding material 52, and to adhere the abrasion resistant material 60 to the sealant 54. In one embodiment, the sealant 54 is exposed to a temperature of between about 300° F. and 375° F. for about two or about three minutes.

The abrasion resistant material 60 is then located on top of the heated, tacky sealant 54. The sealant 54 is then allowed to cool to thereby secure the abrasion resistant material 60 thereto. If desired, only one major surface 56 of the padding material 52 may receive the sealant 54 and/or abrasion resistant material 60 thereon at a time. Alternately, if desired, both sides or major surfaces 56 of the padding material 52 can simultaneously receive the sealant 54 and/or abrasion resistant material 60. The larger sheet of pad material can then be cut to size to provide pads 50 of the desired size and shape. If desired, and if not done earlier, sealant 54 and/or abrasion resistant material 60 can then be located on the end surfaces 58.

When used as padding material at selected portions of a garment, the pads 50 can be located at various locations of the garment. In addition, although not necessarily shown herein, the "pads" 50 may be significantly larger than the shape shown herein and cover nearly all of the surfaces of the garment (i.e., cover substantially the same portion as the outer shell 26 of the coat 10, trousers 40 or the like). When located at select locations, the pads 50 can be located on areas of the garment 10/40 where relatively high loads and/or compression and/or abrasion and/or high heat exposure are expected, such as on the elbows, knees, shoulders and/or hips of the garment.

Figure 2:
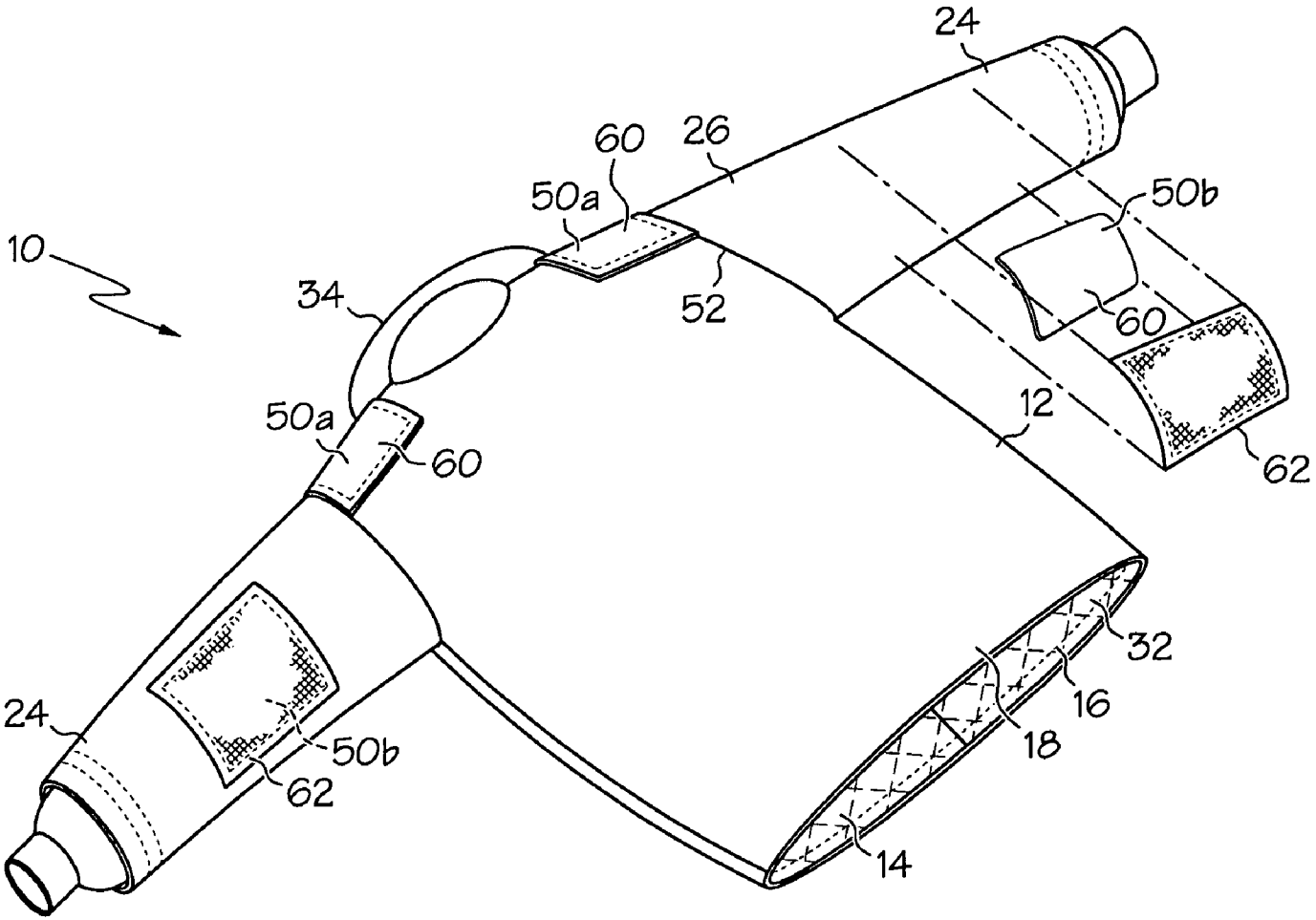
FIG. 2 is a rear view of the garment of FIG. 1, with one of the elbow pads exploded.

The pads 50 can be coupled to the garment in a variety of manners. For example, as shown in FIGS. 1 and 2, in one embodiment the pads 50*a* (shown as shoulder pads in the illustrated embodiment) are simply directly and permanently coupled to outer surface of the outer shell 26. The pads 50*a* can be directly coupled to the outer shell 26 in a variety of manners, such as stitching, adhesives, bonding, sonic or heat welding, etc. In addition, as shown in FIG. 2, if desired the pads 50*b* (shown as elbow pads in the illustrated embodiment) may be located below an outer protective covering 62 such that the pads 50*b* are positioned between the outer shell 26 and the outer protective covering 62. The protective covering 62 can be made of a variety of materials, such as the same material as the outer shell 26, or leather, synthetic leather or the like. In this case, the pads 50*b* may not necessarily be directly coupled to the outer shell 26, due to the fact that the pads 50*b* may be trapped between the associated protective covering 62 and the outer shell 26. However, if desired, the pads 50*b* can be directly coupled to the outer shell 26.

The pads 50 need not necessarily be located outside of the outer shell 26 and could instead be located inside the outer shell 26 (i.e., between the outer shell 26 and the wearer of the garment). In the embodiment shown in FIG. 3, the pads 50*c* (shown as knee pads in the illustrated embodiment) are directly coupled to the underside of the outer shell 26 (and/or to the underlying moisture barrier 28). The pads 50*d* (shown as hip pads in the illustrated embodiment) are located between the moisture barrier 28 and the thermal liner 30, and are coupled to either or both of the layers 28, 30. For example, in one embodiment the pad 50 is directly coupled to the thermal liner 30, such as by stitching that extends around the perimeter of the pad 50. In this case the pad 50 may be directly coupled to the batting 30*a* and/or thermal liner face cloth 30*b* and positioned between the thermal liner 30 and moisture barrier 28.

The pad 50 can be located at any location in the thickness of the garment 10/40 (i.e., between the outer shell 26 and the thermal liner 30, between the outer shell 26 and the moisture barrier 28, between the moisture barrier 28 and the thermal liner 30, between the moisture barrier 28 and the inner liner 32, between the thermal liner 30 and the inner liner 32, between the outer shell 26 and the inner liner 32, etc.). In addition, if desired more than one pad 50 can be located at a single location of the garment. For example, if extra padding is desired (i.e. at the knee) then one pad 50 can be located outside of the outer shell 26 at the knee, and a second pad 50 can be located inside of the outer shell 26 at the knee. Thus, it can be seen that the pads 50 can be located in a variety of positions and used in a variety of manners to provide lightweight, moisture resistant pads to protect a wearer and/or the garment.

Having described the invention in detail and by reference to the preferred embodiments, it will be apparent that modifications and variations thereof are possible without departing from the scope of the invention.

What is claimed is:

1. A garment comprising:

an outer shell configured to be worn on at least part of a body of a wearer; and a pad permanently coupled to said outer shell to provide padding at a selected location, said pad including an open cell, melamine resin foam padding material which resists melting, dripping or igniting when exposed to a temperature of 500 degrees Fahrenheit for five minutes, said padding material having a sealant comprising a urethane coating in solid or liquid form located thereon to reduce the absorption of moisture therein, said pad further including an abrasion resistant material coupled to said padding material by said sealant, wherein said padding material is generally flat and sheet-like having a pair of opposed major surfaces, and wherein each major surface has said sealant covering substantially the entire surface area thereof.

2. The garment of claim 1 wherein said sealant generally covers and seals the open cells of said padding material that are contacted by said sealant.

3. The garment of claim 1 wherein said abrasion resistant material is a woven or non-woven or spun-lace fabric.

4. The garment of claim 1 wherein said pad is coupled to an outer surface of said outer shell such that said outer shell is located to be positioned between said pad and a wearer of said garment.

5. The garment of claim 1 wherein said pad is coupled to an inner surface of said outer shell such that said pad is located to be positioned between said outer shell and a wearer of said garment.

6. The garment of claim 1 wherein said outer shell is in the form of a coat configured to cover the upper torso and arms of a wearer, and wherein said pad is located on an elbow portion or a shoulder portion of said garment.

7. The garment of claim 1 wherein said outer shell is in the form of pair of trousers, and wherein said pad is located on an knee portion or a hip portion of said garment.

8. The garment of claim 1 wherein said sealant is urethane, and wherein each major surface has said abrasion resistant material covering substantially the entire surface area thereof such that said urethane is positioned between said abrasion resistant material and said padding material.

9. The garment of claim 8 wherein said pad resists melting, dripping or igniting when exposed to a temperature of 500 degree Fahrenheit for five minutes.

10. The garment of claim 1 wherein said padding material has a density of less than about 15 kilograms/cubic meter.

11. The garment of claim 1 wherein said padding material has a thickness of at least about 3 mm.

12. The garment of claim 1 further comprising an auxiliary pad directly indirectly permanently coupled to said outer shell at a different selected location of said outer shell to provide padding at said different selected location, said auxiliary pad including an open cell, melamine resin foam padding material which resists melting, dripping or igniting when exposed to a temperature of 500 degrees Fahrenheit for five minutes, said padding material of said auxiliary pad having a sealant comprising a urethane coating in solid or liquid form located thereon to reduce the absorption of moisture therein, said auxiliary pad further including an abrasion resistant material coupled to said padding material of said auxiliary pad by said sealant.

13. The garment of claim 12 wherein said pad and said auxiliary pad are discreet and spaced apart from each other.

14. The garment of claim 1 wherein said abrasion resistant material is securely coupled to said padding material by said sealant such that said abrasion resistant material cannot be removed without damaging said pad.

15. The garment of claim 1 wherein said garment meets National Fire Protection Association 1971 standards for protective firefighting garments.

16. The garment of claim 1 wherein said outer shell is abrasion, flame and heat resistant.

17. The garment of claim 1 wherein said outer shell includes a material selected from a group of consisting of an aramid material, a blend of aramid materials, a polybenzamidazole material, and a blend of aramid and polybenzamidazole materials.

18. The garment of claim 1 further comprising a moisture barrier located generally inside of said outer shell such that when said garment is worn said moisture barrier is located generally between said outer shell and a wearer of said garment, said moisture barrier being made of a material that is generally liquid impermeable and generally moisture vapor permeable.

19. The garment of claim 1 further comprising a thermal liner located generally inside said outer shell such that when said garment is worn said thermal liner is located generally between said outer shell and a wearer of said garment.

20. The garment of claim 19 wherein said thermal liner has a thermal protection performance of at least about 20.

21. The garment of claim 19 wherein said pad is directly coupled to said thermal liner.

22. The garment of claim 1 wherein each major surface has said abrasion resistant material covering substantially the entire surface area thereof.

23. The garment of claim 22 wherein said pad is positioned either inside said outer shell such that said pad is configured to be positioned between said outer shell and a wearer of said garment in a thickness direction thereof, or said pad is positioned outside said outer shell such that said outer shell is configured to be positioned between said pad and said wearer in a thickness direction thereof.

24. A garment comprising:

an outer shell configured to be worn on at least part of a body of a wearer; and a pad permanently coupled to said outer shell to provide padding at a selected location, said pad including an open cell melamine resin foam padding material which resists reciting, dripping or igniting when exposed to a temperature of 500 degrees Fahrenheit for five minutes, said padding material having a sealant comprising a urethane coating in solid or liquid form located thereon to reduce the absorption of moisture therein, said pad further including an abrasion resistant material coupled to said padding material by said sealant, wherein said padding material is generally fiat and sheet-like having a pair of opposed major surfaces, and wherein each major surface has said abrasion resistant material covering substantially the entire surface area thereof and wherein said pad is positioned either inside said outer shell such that said pad is configured to be positioned between said outer shell and a wearer of said garment in a thickness direction thereof, or said pad is positioned outside said outer shell such that said outer shell is configured to be positioned between said pad and said wearer in a thickness direction thereof.

25. The garment of claim 24 wherein each major surface has said sealant covering substantially the entire surface area thereof.

26. The garment of claim 24 wherein said sealant generally covers and seals the open cells of said padding material that are contacted by said sealant.

27. The garment of claim 24 wherein said pad is coupled to an outer surface of said outer shell.

28. The garment of claim 24 wherein said pad is coupled to an inner surface of said outer shell.

29. The garment of claim 24 wherein said outer shell is in the form of a coat configured to cover the upper torso and arms of a wearer, and wherein said pad is located on an elbow portion or a shoulder portion of said coat, or wherein said outer shell is in the form of pair of trousers, and wherein said pad is located on an knee portion or a hip portion of said trousers.

30. The garment of claim 24 wherein said sealant is urethane, and wherein each major surface has said abrasion resistant material covering substantially the entire surface area thereof such that said urethane is positioned between said abrasion resistant material and said padding material.

31. The garment of claim 30 wherein said pad resists melting, dripping or igniting when exposed to a temperature of 500 degree Fahrenheit for five minutes.

32. The garment of claim 24 wherein said padding material has a thickness of at least about 3 mm.

33. The garment of claim 24 wherein said garment meets National Fire Protection Association 1971 standards for protective firefighting garments.

34. The garment of claim 24 wherein said abrasion resistant material overlaps with said outer shell in a thickness direction thereof.

35. A garment comprising:

an outer shell configured to be worn on at least part of a body of a wearer; and a pad permanently coupled to said outer shell to provide padding at a selected location, said pad including:

an open cell, melamine resin foam padding material which is generally flat and sheet-like, having first and a second opposed major surfaces, wherein said padding material resists melting, dripping or igniting when exposed to a temperature of 500 degrees Fahrenheit for five minutes;

first and second pieces of abrasion resistant material coupled to said first and second major surfaces, respectively, and overlapping with said outer shell in a thickness direction thereof and a sealant comprising a urethane coating in solid or liquid form covering substantially the entire surface area of each major surface to reduce the absorption of moisture therein and to couple each piece of abrasion resistant material to the associated major surface.

36. The garment of claim 35 wherein said first and second pieces of abrasion resistant material are generally not coplanar with said outer shell.

* * * * *

UNITED STATES PATENT AND TRADEMARK OFFICE

CERTIFICATE OF CORRECTION

PATENT NO. : 7,913,322 B2
APPLICATION NO. : 11/313205
DATED : March 29, 2011
INVENTOR(S) : Donald Aldridge It is certified that error appears in the above-identified patent and that said Letters Patent is hereby corrected as shown below:

Claim 7, Col. 7, Line 39, insert -- a -- before "pair" and replace "an" with -- a --.

Claim 9, Col. 7, Line 48, replace "degree" with -- degrees --.

Claim 12, Col. 7, Line 54, delete "directly indirectly".

Claim 17, Col. 8, Line 11, replace "group of" with -- group --.

Claim 24, Col. 8, Line 47, replace "reciting" with -- melting --.

Claim 24, Col. 8, Line 54, replace "fiat" with -- flat --.

Claim 29, Col. 9, Line 14, replace "an" with -- a --.

Claim 31, Col. 9, Line 23, replace "degree" with -- degrees --.

Claim 35, Col. 10, Line 11, delete "a".

Claim 35, Col. 10, Line 18, insert -- ; -- after "thereof".

Signed and Sealed this
Thirty-first Day of May, 2011

David J. Kappos

David J. Kappos
*Director of the United States Patent and Trademark Office*